US006686849B1

(12) United States Patent
Cullett

(10) Patent No.: US 6,686,849 B1
(45) Date of Patent: Feb. 3, 2004

(54) EMERGENCY VEHICLE PROXIMITY REPORTING SYSTEM

(76) Inventor: David Cullett, 611 Henry Ford Ave. Box 31, Wilmington, CA (US) 90744

( * ) Notice: Subject to any disclaimer, the term of this patent is extended or adjusted under 35 U.S.C. 154(b) by 10 days.

(21) Appl. No.: 10/145,768

(22) Filed: May 15, 2002

(51) Int. Cl.[7] ..... G08G 1/00
(52) U.S. Cl. ..... 340/902; 340/903; 340/907
(58) Field of Search ..... 340/904, 906, 340/907, 943, 693.3, 903, 902, 988, 933, 825.54, 825.57, 435; 342/386, 385

(56) References Cited

U.S. PATENT DOCUMENTS 3,997,868 A * 12/1976 Ribnick ..... 340/33
4,952,931 A * 8/1990 Serageldin ..... 340/902
5,235,329 A 8/1993 Jackson
5,497,148 A 3/1996 Oliva
5,572,201 A 11/1996 Graham et al.
6,404,351 B1 * 6/2002 Beinke ..... 340/902

* cited by examiner

*Primary Examiner*—Ahn V La

(57) ABSTRACT

A emergency vehicle proximity reporting system for alerting a driver of a vehicle that an emergency vehicle is approaching from a certain direction and at what approximate distance. The emergency vehicle proximity reporting system includes a housing that has a back wall, a front wall, and a perimeter wall for extending there between. The housing defines an interior space. A receiver assembly is positioned substantially within the housing. The receiver assembly is designed for receiving a signal from a transmitter coupled to an emergency vehicle. An indication means provides an alerting indication to the user of a presence of an emergency vehicle.

3 Claims, 5 Drawing Sheets

EMERGENCY VEHICLE PROXIMITY REPORTING SYSTEM

BACKGROUND OF THE INVENTION

1. Field of the Invention

The present invention relates to proximity reporting systems and more particularly pertains to a new emergency vehicle proximity reporting system for alerting a driver of a vehicle that an emergency vehicle is approaching from a certain direction and at what approximate distance.

2. Description of the Prior Art

The use of proximity reporting systems is known in the prior art. U.S. Pat. No. 5,235,329 describes a device capable of alerting a driver of the proximity of an emergency vehicle with the use of a flashing light mounted in the interior of a vehicle. Another type of proximity reporting system is U.S. Pat. No. 5,497,148 describing a means for warning a driver of various traffic situations including the audible message. U.S. Pat. No. 5,572,201 describes a system for alerting a person of an emergency situation using a visual or acoustic alerting device.

While these devices fulfill their respective, particular objectives and requirements, the need remains for a system that includes an alerting device using a light system for indicating the direction and proximity of an emergency vehicle as described.

SUMMARY OF THE INVENTION

The present invention meets the needs presented above by indicating the direction and proximity of an emergency vehicle.

Another object of the present invention is to provide a new emergency vehicle proximity reporting system that allows emergency vehicles to get through traffic safely and quickly.

Still another object of the present invention is to provide a new emergency vehicle proximity reporting system that would aid the emergency crew in saving lives during time critical emergency situations.

To this end, the present invention generally comprises a housing that has a back wall, a front wall, and a perimeter wall for extending there between. The housing defines an interior space. A receiver assembly is positioned substantially within the housing. The receiver assembly is designed for receiving a signal from a transmitter coupled to an emergency vehicle. An indication means provides an alerting indication to the user of a presence of an emergency vehicle.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
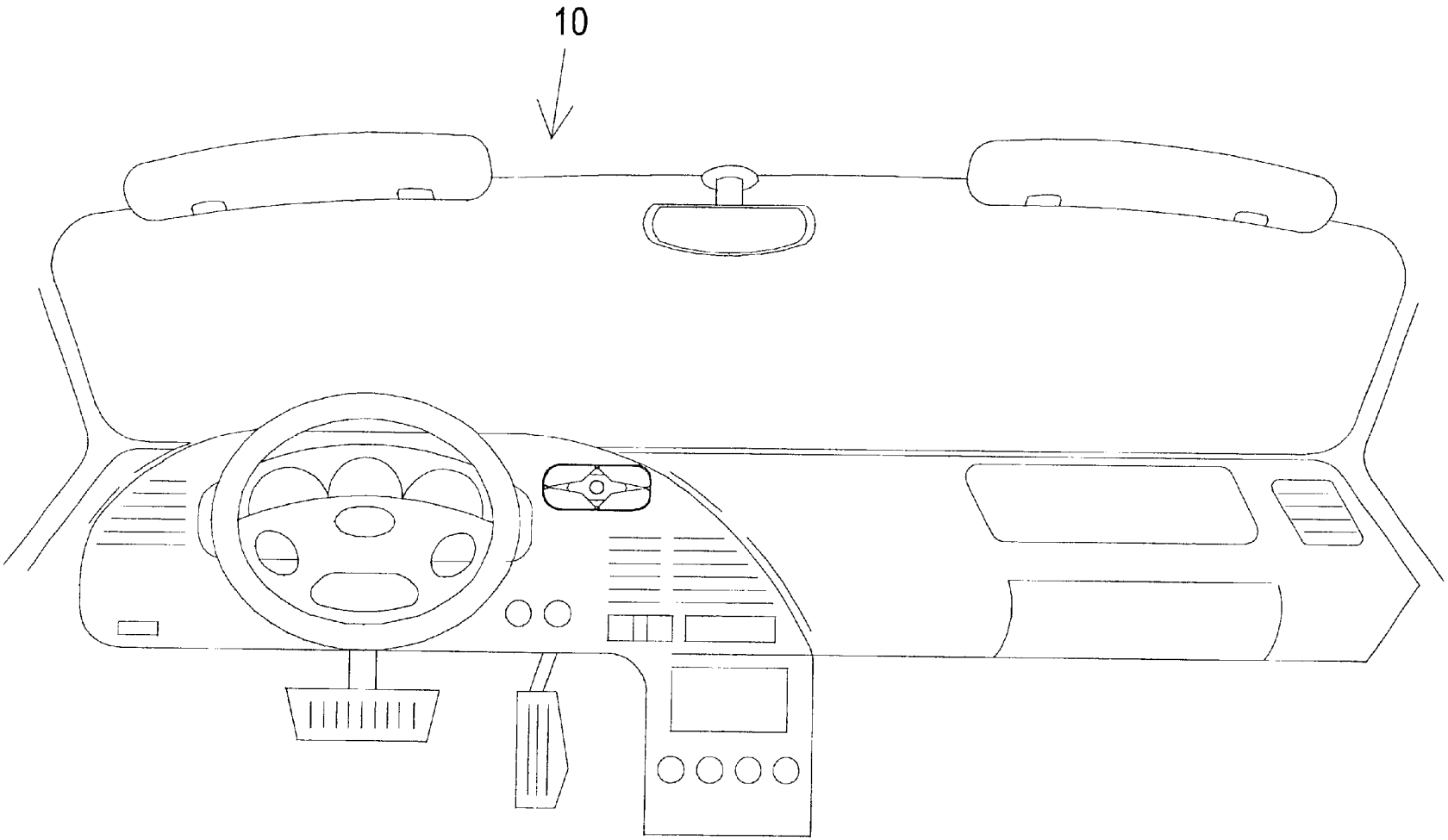
FIG. 1 is an in-use view of a new emergency vehicle proximity reporting system according to the present invention.
Figure 2:
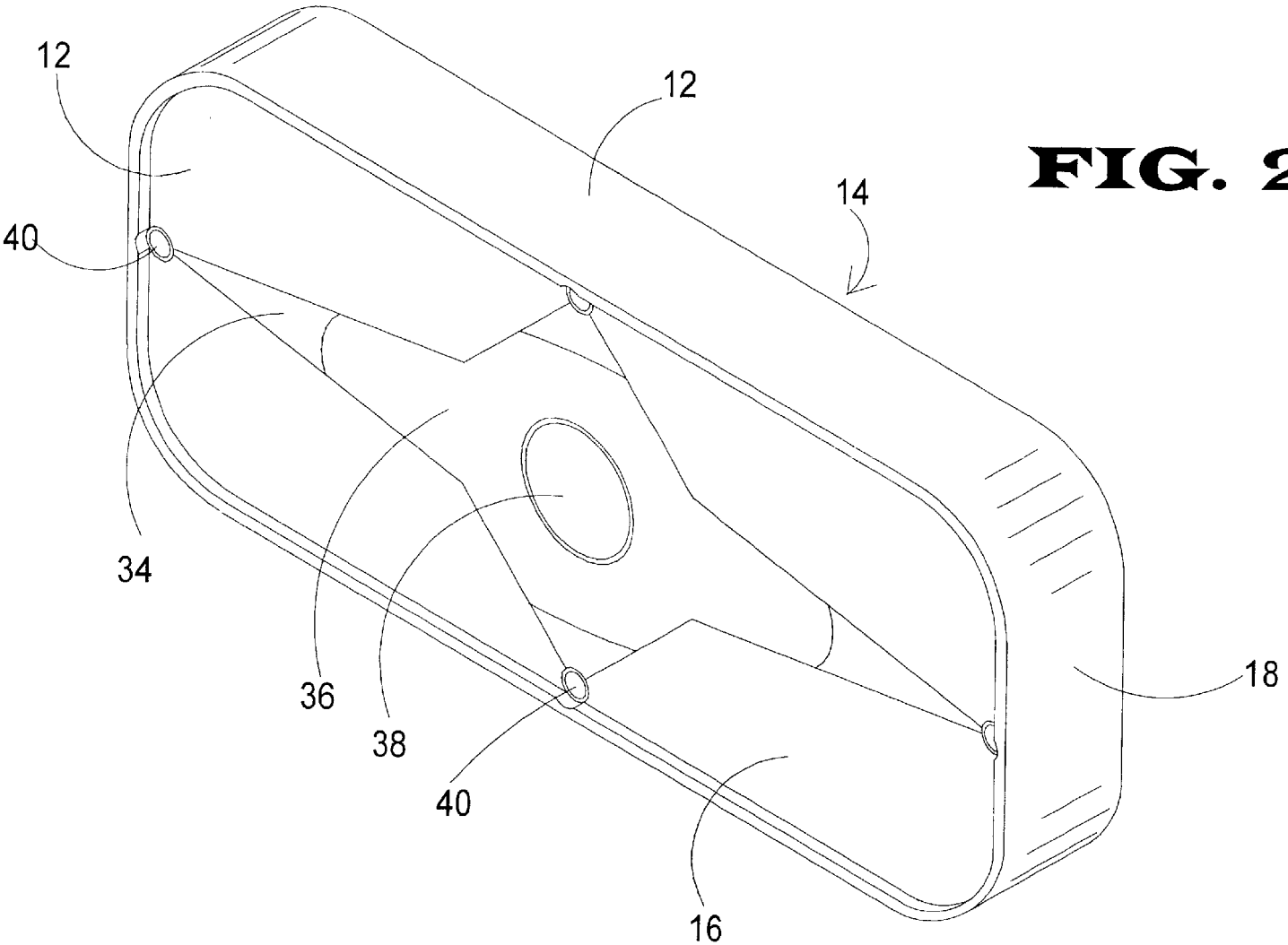
FIG. 2 is a perspective view of the present invention.
Figure 3:
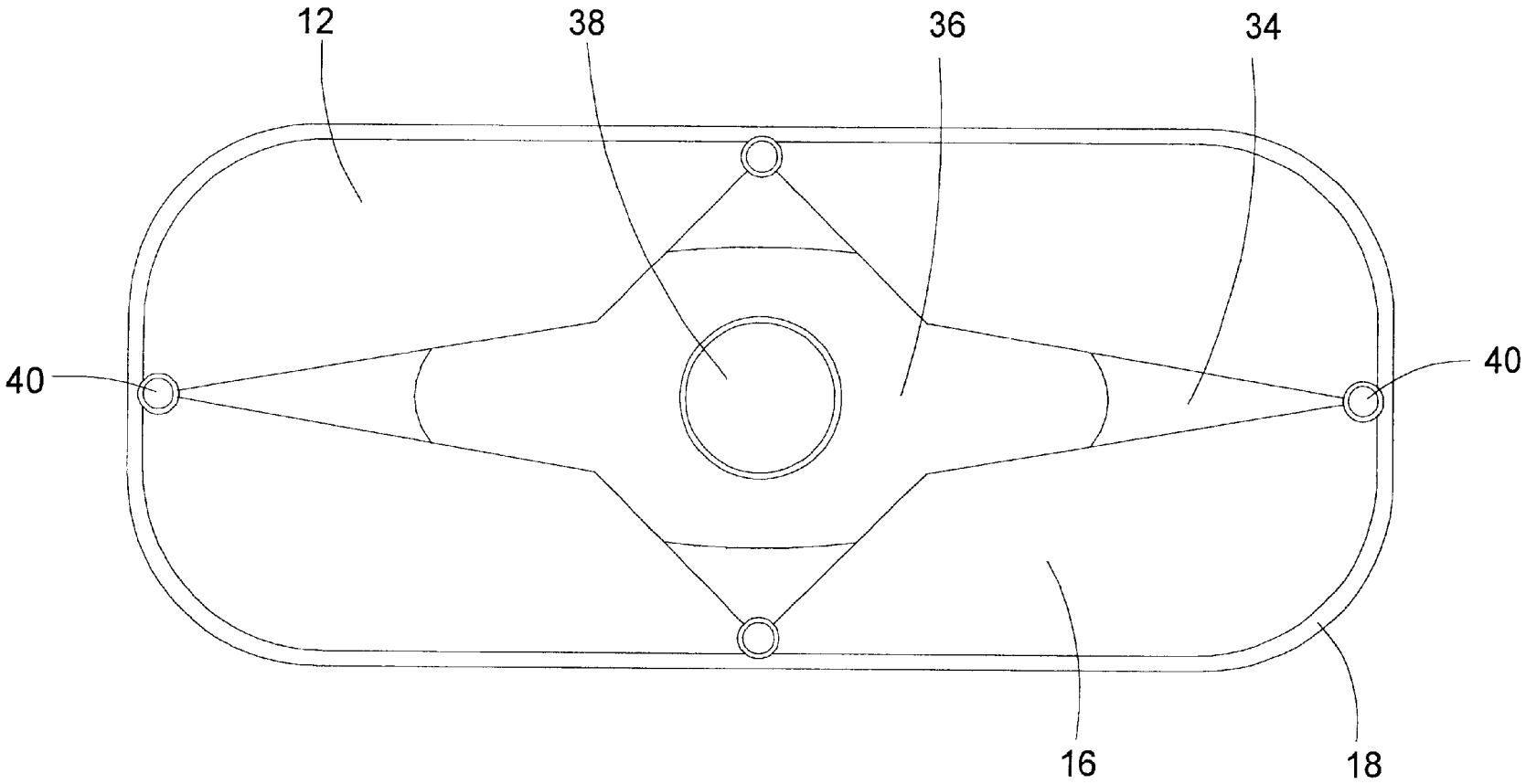
FIG. 3 is a front view of the present invention.
Figure 4:
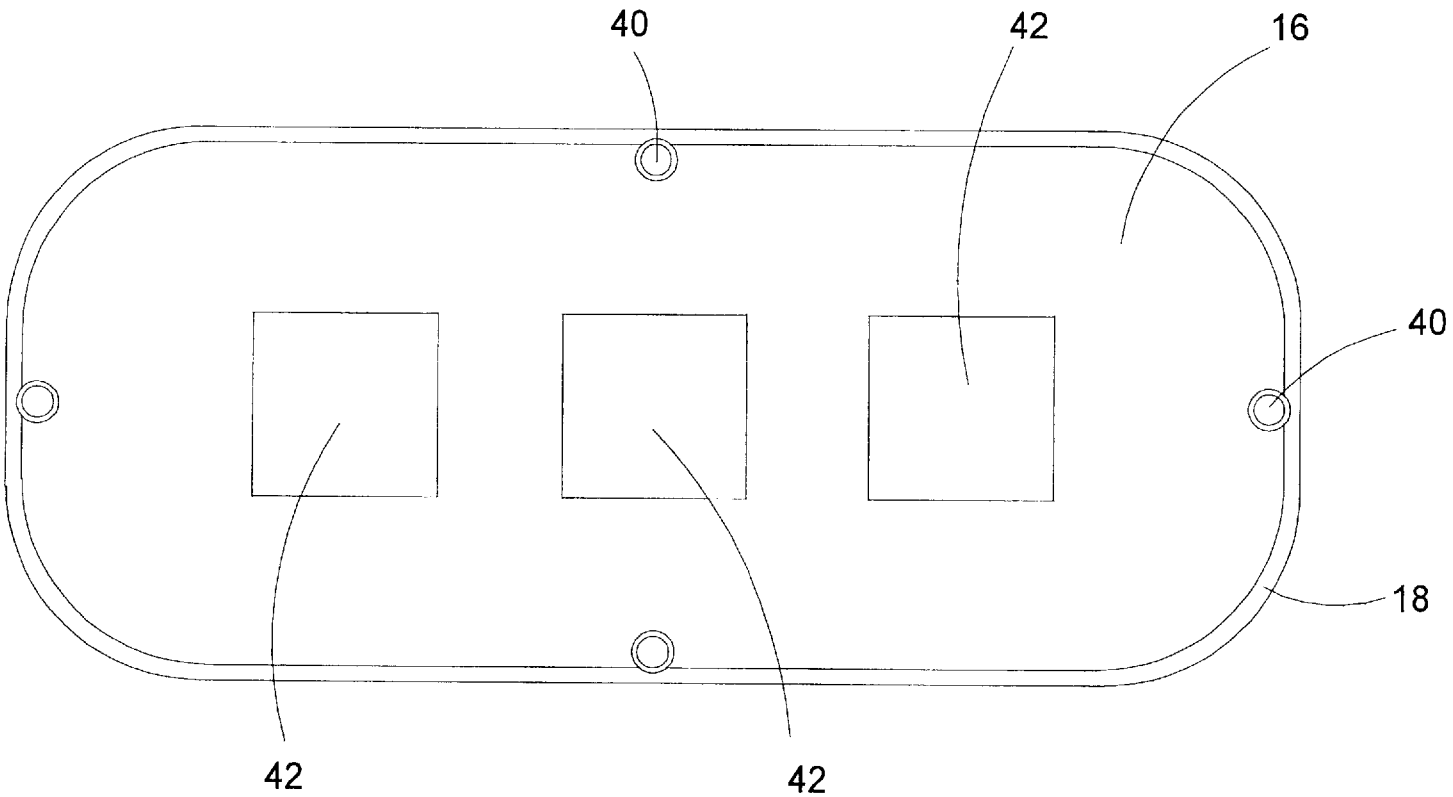
FIG. 4 is a front view of the present invention.
Figure 5:
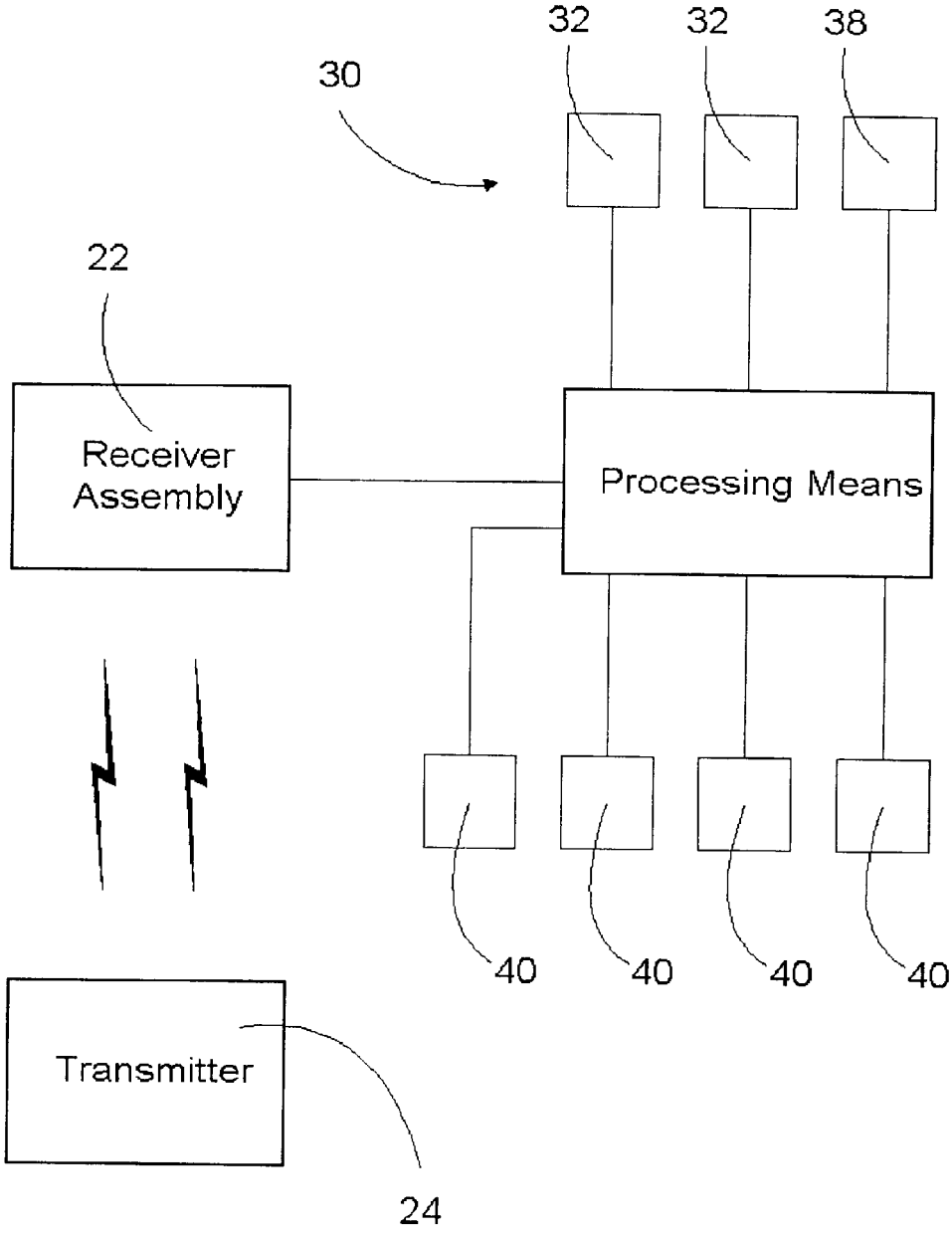
FIG. 5 is a block diagram view of the present invention.

With reference now to the drawings, and in particular to FIGS. 1 through 5 thereof, a new emergency vehicle proximity reporting system embodying the principles and concepts of the present invention and generally designated by the reference numeral 10 will be described.

As best illustrated in FIGS. 1 through 5, the emergency vehicle proximity reporting system 10 generally comprises a housing 12 that has a back wall 14, a front wall 16, and a perimeter wall 18 for extending there between. The housing 12 defines an interior space 20. A receiver assembly 22 is positioned substantially within the housing 12. The receiver assembly 22 is designed for receiving a signal from a transmitter 24 coupled to an emergency vehicle. An indication means 26 provides an alerting indication to the user of a presence of an emergency vehicle. The receiver assembly 22 further includes a processing means 28. The processing means 28 is for analyzing the signal received. The processing means 28 determines a relative direction of the emergency vehicle. The processing means 28 determines a relative distance of the emergency vehicle.

The receiver assembly 22 further includes a processing means 28. The processing means 28 is for analyzing the signal received. The processing means 28 determines a relative direction of the emergency vehicle. The processing means 28 determining a relative distance of the emergency vehicle.

The indication means 30 further includes a plurality of indicator lamps 32. Each one of the plurality of indicator lamps 32 is uniquely associated with a relative distance of the emergency vehicle. Each one of the plurality of indicator lamps 32 is positioned substantially on the front wall 16 of the housing 12. Each one of the indicator lamps 32 is operationally coupled to the receiver assembly 22. The plurality of indicator lamps 32 further includes a first quartet of indicator lamps 34. Each one of the first quartet of indicator lamps 34 is operationally coupled to the receiver assembly 22. Each one of the first quartet of indicator lamps 34 is associated with a first relative distance. Each one of the first quartet of indicator lamps 34 is uniquely associated with a relative direction. Each one of the first quartet of indicator lamps 34 is illuminatable by the receiver assembly 22 for providing an visual indication for the user that an emergency vehicle is within the first relative distance and positioned approximately at the relative direction.

Each one of the second quartet of indicator lamps 36 is operationally coupled to the receiver assembly 22. Each one of the second quartet of indicator lamps 36 is associated with a second relative distance. The second relative distance is substantially less than the first relative distance. Each one of the second quartet of indicator lamps 36 is uniquely associated with a relative direction. Each one of the second quartet of indicator lamps 36 is illuminatable by the receiver assembly 22 for providing an visual indication for the user that an emergency vehicle is within the second relative distance and positioned approximately at the relative direction.

A proximity indicator lamp 38 is operationally coupled to the receiver assembly 22. The proximity indicator lamp 38 is associated with a third relative distance. The third relative distance is substantially less than the second relative distance. The proximity indicator lamp 38 provides a visual indication for the user than an emergency vehicle is within the third relative distance. The first relative distance is greater than 150 yards, the second relative distance is greater than 100 yards, the third relative distance is less than 50 yards.

In an embodiment the plurality of indicator lamps 32 further includes a plurality of relative direction lamps 40. Each one of the plurality of relative direction lamps 40 is uniquely associated with a relative directions. Each one of the plurality of relative direction lamps 40 is operationally coupled to the receiver assembly 22 and illuminatable by the receiver assembly 22. The plurality of relative direction lamps 40 providing a visual indication to the user of a relative direction of the emergency vehicle.

Each one of the plurality of relative distance lamps 42 is uniquely associated with a relative distance. Each one of the plurality of relative distance lamps 42 is operationally coupled to the receiver assembly 22 and illuminatable by the receiver assembly 22. The plurality of relative distance lamps 42 providing a visual indication to the user of a relative distance of the emergency vehicle.

In use, a user would mount the present invention to a dash board of a vehicle or other location that can be easily viewed by the driver. When an emergency vehicle approaches indication lamps light to show the direction of the emergency vehicle and the distance of the emergency vehicle proximate to your vehicle.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An emergency vehicle proximity reporting system comprising:

a housing having a back wall, a front wall, and a perimeter wall extending there between, said housing defining an interior space, said housing being adapted for coupling to an interior of a vehicle such that indication means provides an alerting indication to a user while driving;

a receiver assembly positioned substantially within said housing, said receiver assembly being adapted for receiving a signal from a transmitter coupled to an emergency vehicle; and a indication means providing a alerting indication to the user of a presence of an emergency vehicle;

wherein said receiver assembly further comprises a processing means said processing means being for analyzing the signal received, said processing means determining a relative direction of the emergency vehicle, said processing means determining a relative distance of the emergency vehicle;

wherein said indication means further comprises a plurality of indicator lamps, each one of said plurality of indicator lamps being uniquely associated with a relative distance of the emergency vehicle, each one of said plurality of indicator lamps being positioned substantially on said front wall of said housing, each one of said indicator lamps being operationally coupled to said receiver assembly;

a first quartet of indicator lamps, each one of said first quartet of indicator lamps being operationally coupled to said receiver assembly, each one of said first quartet of indicator lamps being associated with a first relative distance, each one of said first quartet of indicator lamps being uniquely associated with a relative direction, each one of said first quartet of indicator lamps being illuminatable by said receiver assembly for providing an visual indication for the user that an emergency vehicle is within said first relative distance and positioned approximately at said relative direction;

a second quartet of indicator lamps, each one of said second quartet of indicator lamps being operationally coupled to said receiver assembly, each one of said second quartet of indicator lamps being associated with a second relative distance, said second relative distance being substantially less than said first relative distance, each one of said second quartet of indicator lamps being uniquely associated with a relative direction, each one of said second quartet of indicator lamps being illuminatable by said receiver assembly for providing an visual indication for the user that an emergency vehicle is within said second relative distance and positioned approximately at said relative direction; and a proximity indicator lamp operationally coupled to said receiver assembly, said proximity indicator lamp being associated with a third relative distance, said third relative distance being substantially less than said second relative distance, said proximity indicator lamp providing a visual indication for the user than an emergency vehicle is within said third relative distance.

2. The system of claim 1, wherein said first relative distance being greater than 150 yards, said second relative distance being greater than 100 yards, said third relative distance being less than 50 yards.

3. The system of claim 1, wherein said plurality of indicator lamps further comprises:

a plurality of relative direction lamps, each one of said plurality of relative direction lamps being uniquely associated with a relative directions, each one of said plurality of relative direction lamps being operationally coupled to said receiver assembly and illuminatable by said receiver assembly said plurality of relative direction lamps providing a visual indication to the user of a relative direction of the emergency vehicle; and a plurality of relative distance lamps, each one of said plurality of relative distance lamps being uniquely associated with a relative distance, each one of said plurality of relative distance lamps being operationally coupled to said receiver assembly and illuminatable by said receiver assembly, said plurality of relative distance lamps providing a visual indication to the user of a relative distance of the emergency vehicle.

* * * * *